US008540461B2

(12) United States Patent
Ong

(10) Patent No.: US 8,540,461 B2
(45) Date of Patent: Sep. 24, 2013

(54) CIRCULAR PILE HEAD FOR UNDERPINNING A SLAB

(76) Inventor: Chin Chai Ong, Kuala Lumpur (MY)

( * ) Notice: Subject to any disclaimer, the term of this patent is extended or adjusted under 35 U.S.C. 154(b) by 1 day.

(21) Appl. No.: 13/257,448

(22) PCT Filed: Oct. 1, 2009

(86) PCT No.: PCT/MY2009/000164

§ 371 (c)(1),
(2), (4) Date: Sep. 19, 2011

(87) PCT Pub. No.: WO2010/107296

PCT Pub. Date: Sep. 23, 2010

(65) Prior Publication Data

US 2012/0014754 A1 Jan. 19, 2012

(30) Foreign Application Priority Data

Mar. 20, 2009 (MY) ..... P120091130

(51) Int. Cl.
*E02D 35/00* (2006.01)

(52) U.S. Cl.
USPC ..... 405/230; 405/232

(58) Field of Classification Search
USPC ..... 405/130–132, 230–232; 52/299; 404/78
See application file for complete search history.

(56) References Cited

U.S. PATENT DOCUMENTS

| | | | | |
|---|---|---|---|---|
| 4,563,110 | A * | 1/1986 | Langenbach et al. | 405/230 |
| 4,591,466 | A * | 5/1986 | Murray et al. | 405/230 |
| 5,205,673 | A * | 4/1993 | Bolin et al. | 405/230 |
| 5,549,168 | A * | 8/1996 | Sadler et al. | 173/49 |
| 5,722,798 | A | 3/1998 | Gregory | |
| 6,044,226 | A * | 3/2000 | McWilliams | 396/1 |
| 6,254,314 | B1 * | 7/2001 | Park et al. | 405/255 |
| 6,368,023 | B1 | 4/2002 | Lau | |
| 6,390,734 | B1 * | 5/2002 | Marshall | 405/230 |
| 6,840,714 | B1 * | 1/2005 | Vache | 405/230 |
| 7,300,230 | B2 | 11/2007 | Ong | |
| 7,607,865 | B2 * | 10/2009 | Gregory et al. | 405/251 |
| 8,459,897 | B1 * | 6/2013 | Knapp | 404/78 |
| 2006/0216117 | A1 | 9/2006 | Peterson | |
| 2009/0025332 | A1 * | 1/2009 | Richards | 52/704 |
| 2009/0245942 | A1 * | 10/2009 | Hawkins et al. | 405/230 |
| 2010/0080658 | A1 * | 4/2010 | Marshall | 405/232 |

FOREIGN PATENT DOCUMENTS

| | | | |
|---|---|---|---|
| JP | 56089626 | A * | 7/1981 |
| JP | 02289704 | A * | 11/1990 |
| KR | 20000002770 | U | 2/2000 |
| KR | 20030078228 | A | 10/2003 |
| WO | WO 2007136152 | A1 * | 11/2007 |

OTHER PUBLICATIONS

International Search Report for PCT/MY2009/000164, Completed by the Korean Intellectual Property Office on May 20, 2010, 2 Pages.

* cited by examiner

*Primary Examiner* — Thomas B Will
*Assistant Examiner* — Jessica H Lutz
(74) *Attorney, Agent, or Firm* — Brooks Kushman PC

(57) ABSTRACT

A circular pile head assembly that can facilitate the driving of the underpinning pile in a slab using a pile driving machine and locking-off the slab load to the underpinning pile is provided. A circular pile head assembly consists of the twin beam, the circular pile head and a section of an underpinning pile that is used in conjunction with a pile driving machine to drive, and lock-off the slab load to the underpinning pile.

11 Claims, 8 Drawing Sheets

CIRCULAR PILE HEAD FOR UNDERPINNING A SLAB

CROSS-REFERENCE TO RELATED APPLICATION

This application is the U.S. national phase of PCT Appln. No. PCT/MY2009/000164 filed Oct. 1, 2009 which claims priority to Malaysian application P120091130 filed Mar. 20, 2009, the disclosures of which are incorporated in their entirety by reference herein.

TECHNICAL FIELD OF THE INVENTION

This innovation refers to a circular pile head assembly that can facilitate driving of the underpinning pile in a raft foundation using a pile driving machine and locking-off the transferred load to the underpinning pile. To achieve this purpose, it would be necessary to have features in the pile head that can accommodate the entry of the underpinning pile through the pile head and yet the pile head can be easily inserted into a small pre-bored hole in the slab.

BACKGROUND OF THE INVENTION

In the prior art U.S. Pat. No. 7,300,230 B2 requires the excavation of a hole to access the pile cap or ground beams and using transfer beams to attach the pile head. However this would be undesirable in the case of a raft foundation, as this excavation will weakened the slab. Moreover, in most cases the slab will be strong enough to support the underpinning pile if it can be placed underneath the slab. Hence, a pin hole pre-bored in the slab will ensure that the shear in the concrete slab is not compromised, especially if the underpinning pile is placed near to the main support columns.

In the prior art U.S. Pat. No. 2006/0216117 A1, teaches the insertion of a bracket through an opening and far enough into the excavated area underneath the slab. The soil below the enlarged opening is excavated to allow room for the subject bracket to be inserted below the slab. The bracket is then welded with rebar and concrete is introduced into the excavated region and hardened around the bracket and rebar to produce a three dimensional plug so that it can support the slab. Clearly, until the concrete hardens in this prior art, the full structural capacity of the slab around the opening will be compromised during lifting. Whereas the present invention overcomes this difficulty and allows the slab to be immediately lifted up or used to drive the underpinning pile without using concrete, rebars or likes to form a plug. In this same prior art, the lifting mechanism is through tightening the screws in the pair of threaded rods, which is independently attached to the tubing which is not connected directly to the brackets. Thus any failure in the weakest link can occur between tubing and the treaded rods or between the tubing and the bracket. The present invention has large welding contact areas and a plurality of welded wedges to support the pile head directly on to the slab, thus avoiding a double weak link as in faced in the prior art.

. SUMMARY OF THE INVENTION

This innovation refers to a circular pile head assembly that can facilitate driving of the underpinning pile in a raft foun dation using a pile driving machine, and locking-off the transferred load to the underpinning pile. The components used in the circular pile head assembly consists of a twin beam lifting attachment, the circular pile head, pile head plate and a section of an underpinning pile.

A pre-bored hole will be made in the slab to a size complementary to the outer circular pile head diameter so that it can be inserted through the opening of the pre-bored hole. The circular pile head has a concentric bearing plate with two edges trimmed off so that it be inserted unobstructed into the pre-bored through a hole in the slab, and then displaced in opposite directions as a pair of the circular pile head, ready to receive the underpinning pile.

The circular pile head assembly will be connected to the pile driving machine at both ends of the twin beam. The lock pins will be inserted through the upper hook and a lower through hole correspondingly of the twin beams that is aligned to the through opening of the pile driving machine.

The downward driving process of the underpinning pile through the circular pile head assembly, is achieved by the counter-reaction in the shearing of the top and bottom lock pins held down against uplift by the upper body section of the circular pile head through the protruding hook and resisted against the soffit of the slab by the concentric bearing plates at the lower ends of the circular pile head. In this way, the circular pile head assembly can allow the dead weight of the foundation, and the pile driving machine to provide sufficient kentiledge to drive the next underpinning pile downwards.

The locking mechanism is achieved by placing the circular pile head plate over the top of the underpinning pile and securing the circular pile head plate preferably through welding to the body section of the circular pile head and further strengthened by a plurality of wedges.

BRIEF DESCRIPTION OF THE DRAWINGS

Further understanding of the aspects of the present invention and their advantages will be discerned after studying the detailed description in conjunction with the accompanying drawings in which.

DETAILED DESCRIPTION OF THE INVENTION

Figure 1:
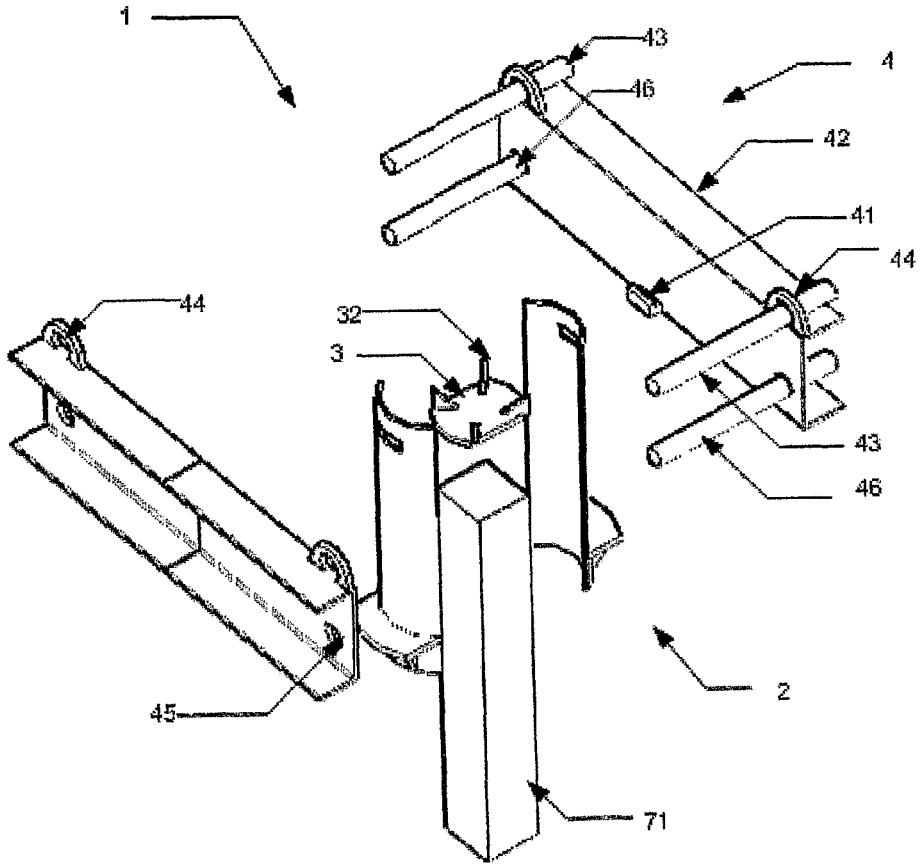
FIG. 1 shows the blown apart components of the circular pile head assembly with twin beam lifting attachments.

Referring to the drawings, like numerals indicate like components to facilitate explanation. In order to differentiate two separate entities belonging to like components, a suffix "a" or "b" is used to denote the first and second entity. Components of the Circular Pile Head Assembly (1):

FIG. 1 shows the exploded view of the components used in the circular pile head assembly (1) consisting of the twin beam lifting attachment (4), the circular pile head (2) and a section of an underpinning pile (71).

Figure 2:
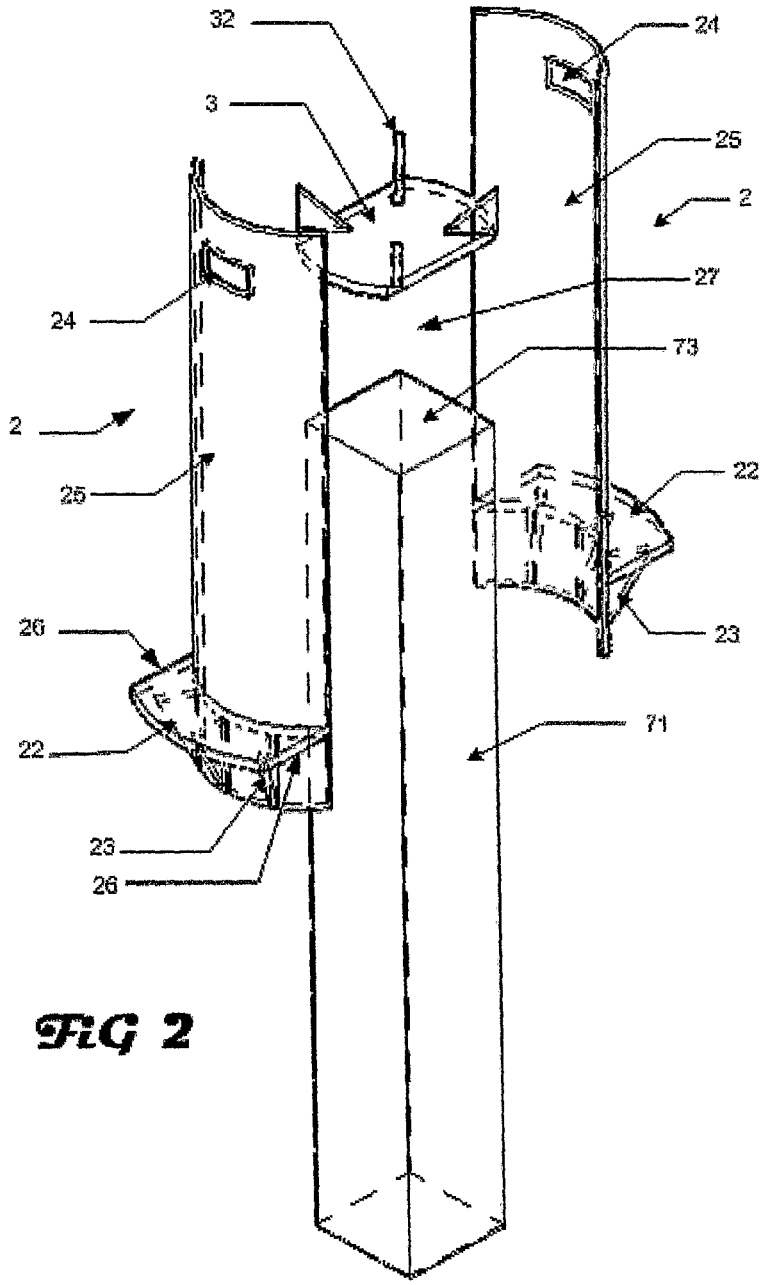
FIG. 2 shows the details of the components of the circular pile head that will be inserted through a pre-bored hole in the slab.

FIG. 2 shows the circular pile head (2) where at the middle bottom end of the twin 1 beams (42) there is provided a protruding hook (41) (FIG. 1) that will be inserted through a tabular cut-out section (24) in the upper body section of the circular pile head (25). A concentric bearing plate (22) is welded near to the base of the body section of the circular pile head (25), and additionally supported by a plurality of triangular wedges (23).

Figure 3:
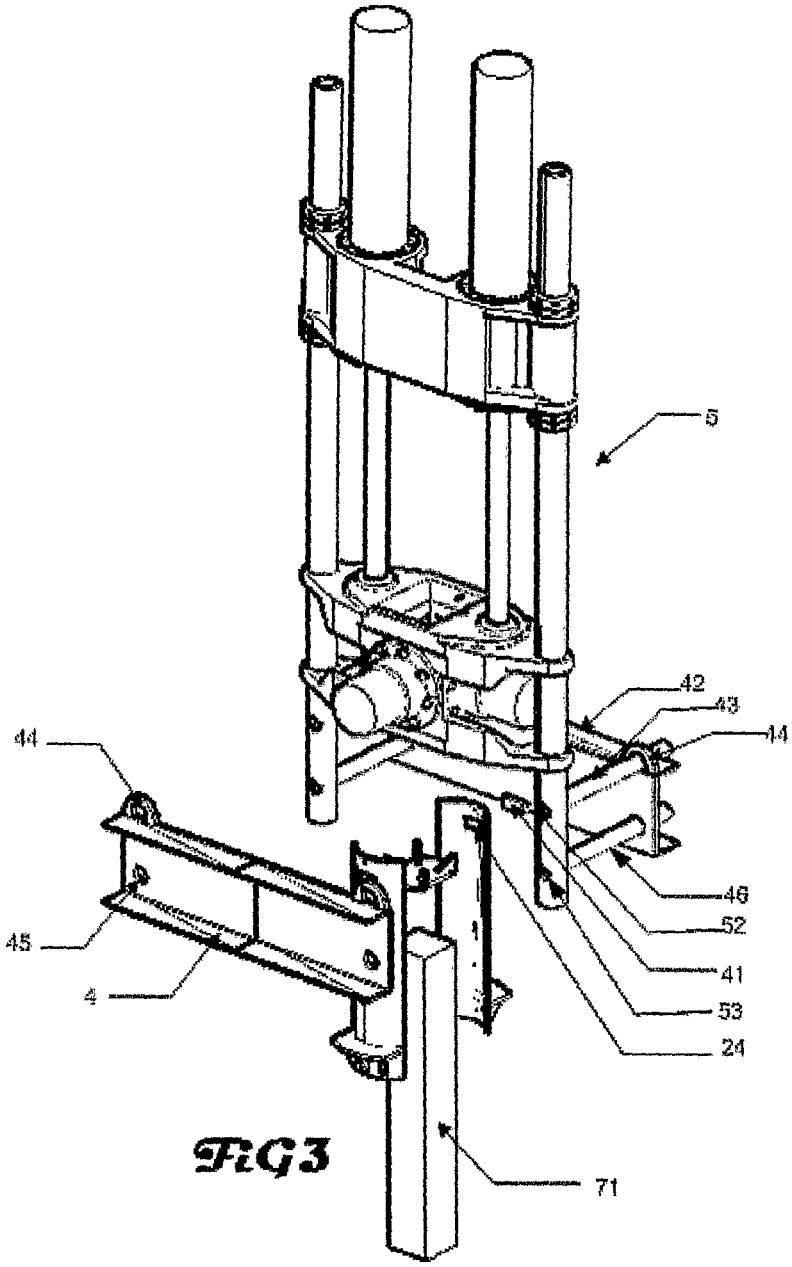
FIG. 3 shows the pile driving machine that will be attached to the twin beam lifting attachments and the circular pile head assembly.

FIG. 3 shows the exploded view of the connection between the circular pile head assembly (1) that will be connected to the pile driving machine (5) at both ends of the twin beam (42). The lock pins (43, 46) will be inserted through an upper hook (44) and a lower through hole (45) of the twin beams (42) correspondingly that is aligned to the through opening (52,53) of the pile driving machine (5).

Figure 4:
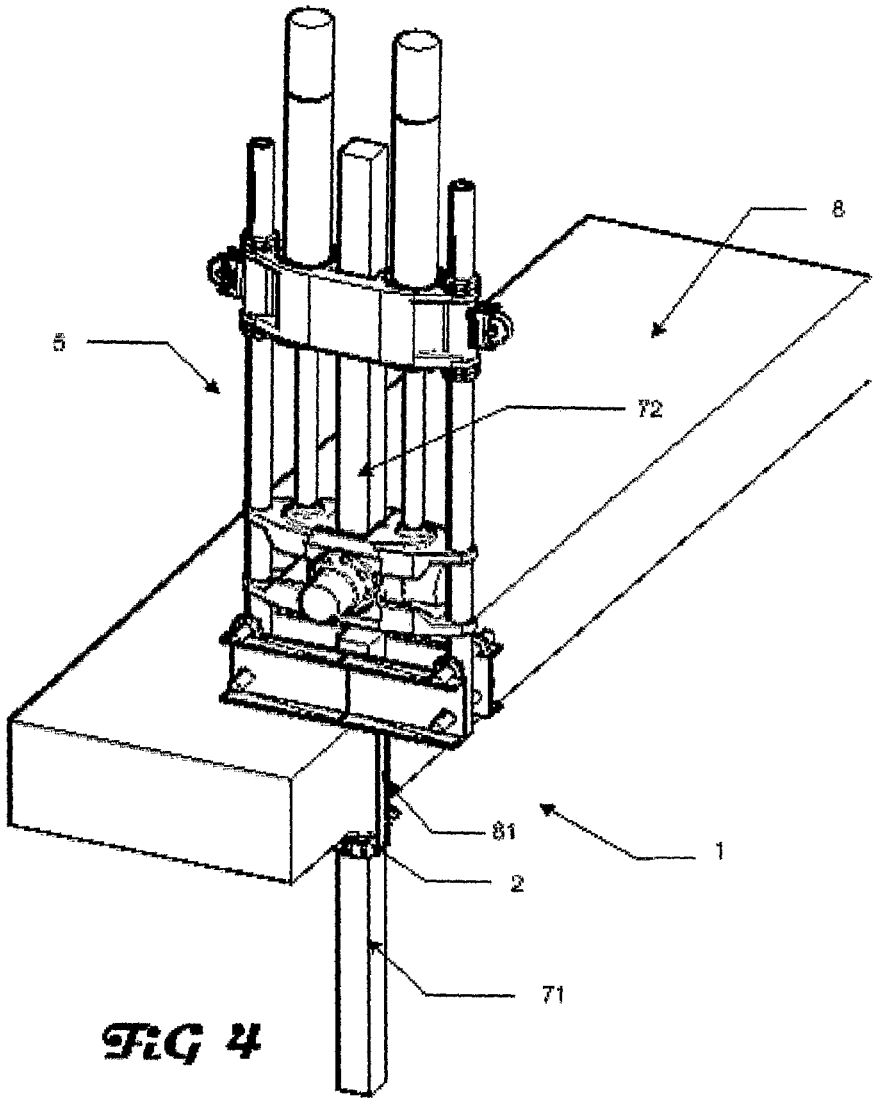
FIG. 4 shows the completed assembled circular pile head attached to the pile driving machine ready to drive the underpinning pile.

As shown in FIG. 3 and FIG. 4 during driving of the underpinning pile (71) through the circular pile head assembly (1) is achieved by the counter-reaction in the shearing of the top and bottom lock pins (43) held down against uplift by upper body section of the circular pile head (25) through the protruding hook (41) and resisted against the soffit of the slab (8) by the concentric bearing plates (22) at the lower ends of the body section of the circular pile head (25). In this way, the circular pile head assembly (1) can allow the dead weight of the foundation and the pile driving machine (5) to provide sufficient kentiledge to drive the next underpinning pile (72) downwards.

Figure 5:
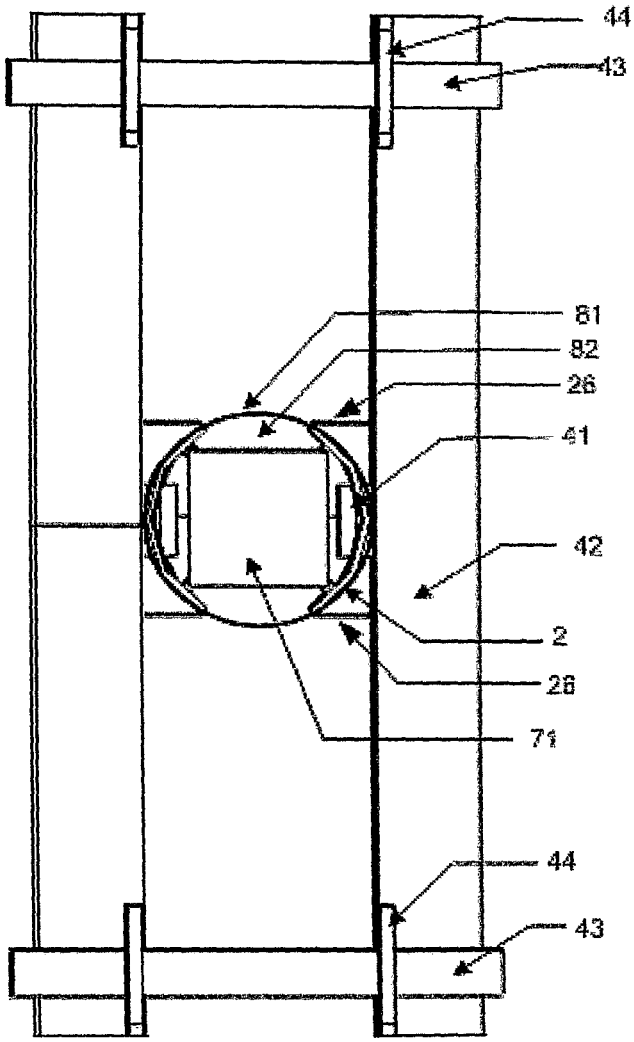
FIG. 5 shows the top view of the assembled circular pile head that was inserted snugly through the pre-bored hole in the slab.

FIG. 5 shows the top view of the assembled circular pile head (2) that was inserted snugly 1 through the pre-bored hole in the slab. The concentric bearing plate (22) (FIG. 2) has two parallel edges (26) trimmed off so that it be inserted unobstructed into the pre-bored through hole (81) in the slab (8) and then displaced in opposite directions as a pair of the circular pile head (2) displayed in FIG. 5 and FIG. 6.

Figure 6:
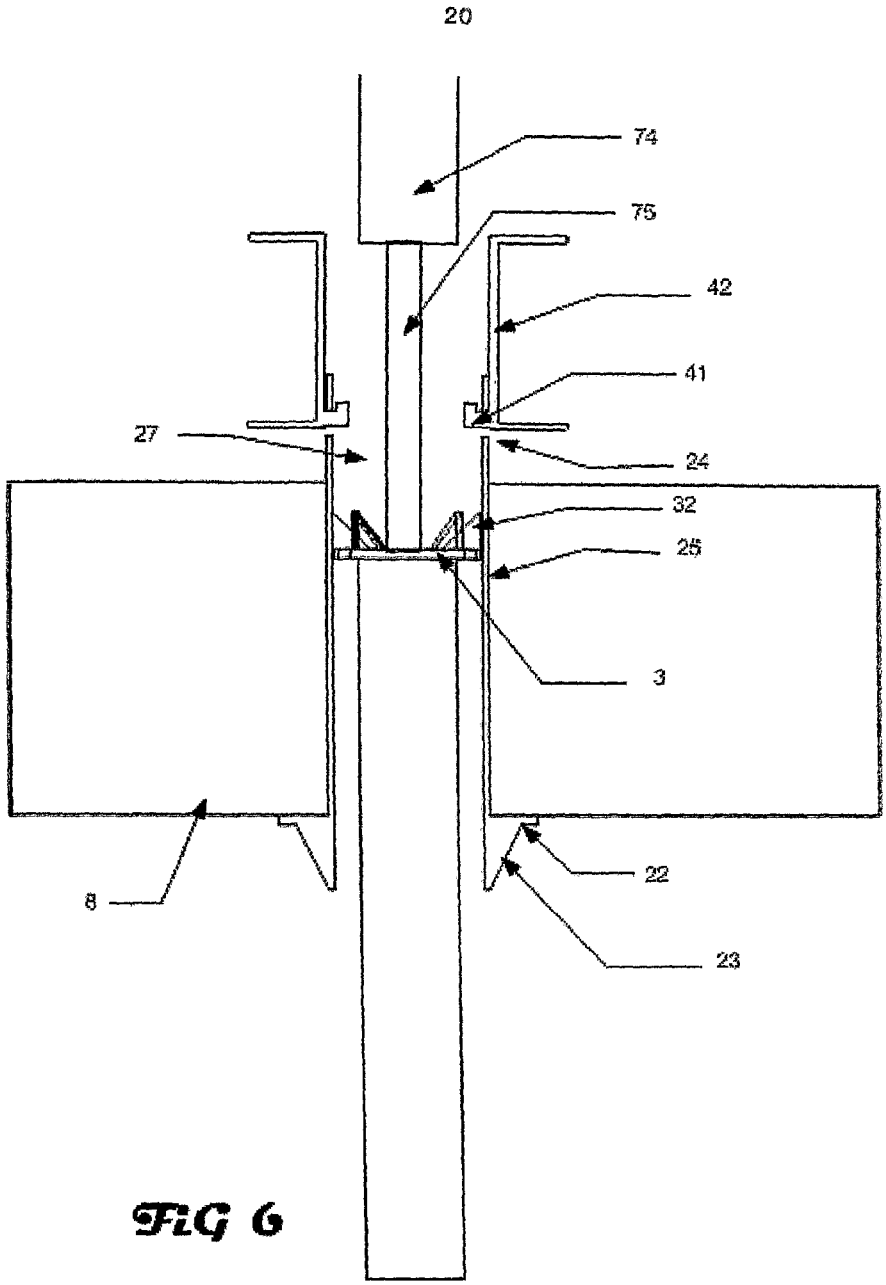
FIG. 6 shows a cross-section view of the assembled circular pile head during pre-loading of the underpinning pile.
Figure 7:
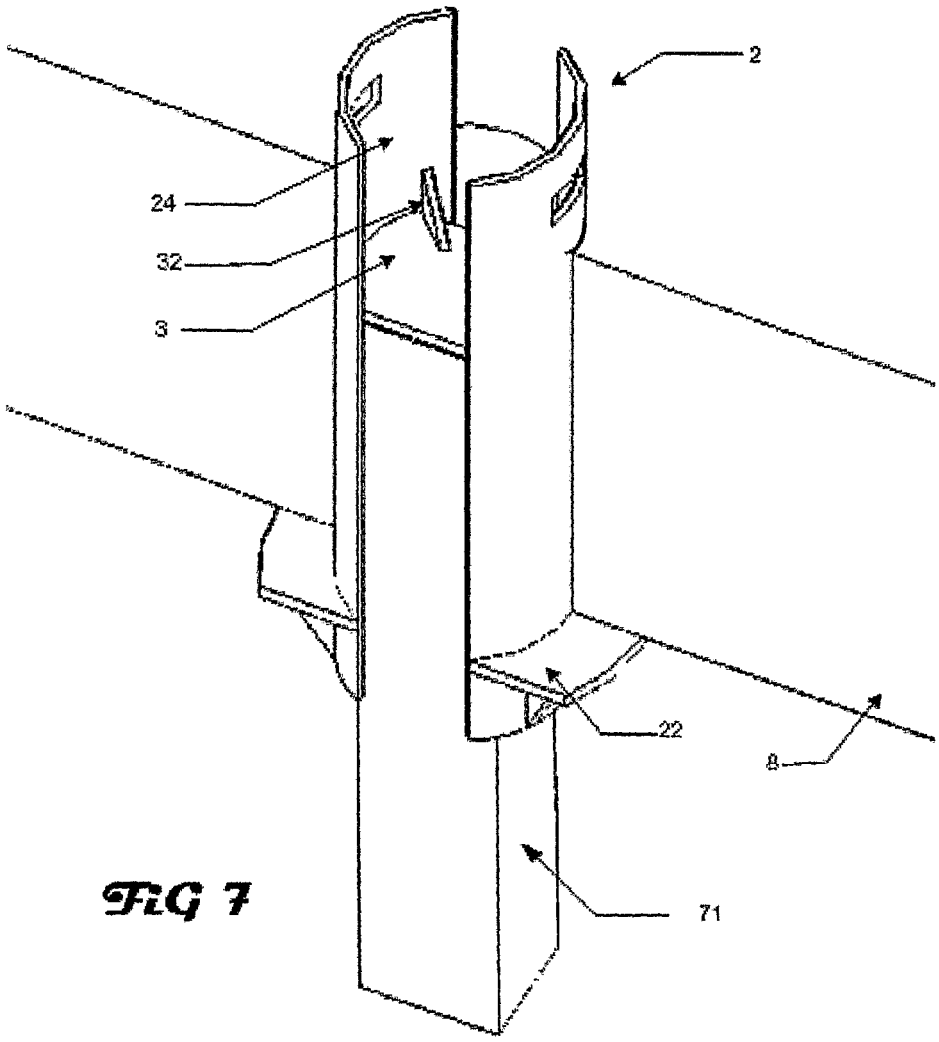
FIG. 7 shows the isometric view of the circular pile head with wedges ready to be welded on to the circular pile head plate after completion of preloading the underpinning pile (the pile diving machine's extended jack not shown for clarity).

FIG. 6 shows the circular pile head assembly (1) when connected to the pile driving machine (5) at the middle lower sections of the twin beam (42) through the protruding hook (41) that was already inserted through a tabular cut-out section (24) in the upper body section of the circular pile head (25). To lock up the preload after completion of driving the underpinning pile (71), the pile driving machine (5) jack is extended (75) against the circular pile head plate (3) located on top of the underpinning pile (73) such that the concentric bearing plate (22) will bear up against the soffit of the pre-bored through hole (81) to lift up the slab (8). A plurality of wedges (23) will be welded on to the circular pile head plate (3) and the inner side of the body section of the circular pile head (25) to lock up the preloaded foundation load as shown the isometric view of FIG. 7 and FIG. 8.

Figure 8:
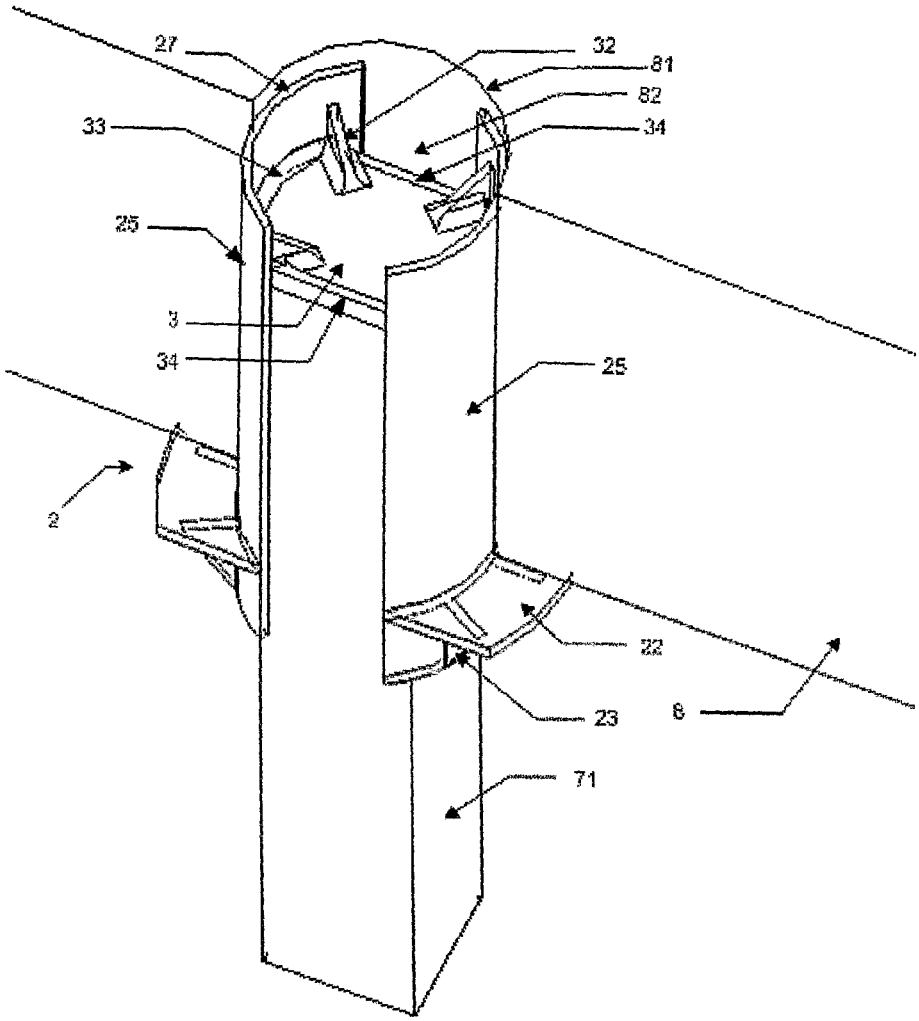
FIG. 8 shows that the circular pile head is cut-off below the ground level of the slab and cement grout which will be poured into the spaces between the underpinning pile and the pre-bored hole.

FIG. 8 shows the circular pile head (2) is cut-off (27) below the ground level of the slab (8) and later cement grout will be poured into the voids (82) between the trimmed parallel edges (34) and the pre-bored hole (81).

The invention claimed is:

1. A circular pile head assembly comprising:

a twin beam lifting attachment having a pair of beams configured to be placed above a pre-bored hole in a slab, each beam having a first connector;

a tubular pile head including a pair of partial-cylindrical segments, each segment having a bearing plate extending generally transverse therefrom for engagement with an underside of the slab, each segment further having a second connector configured to connect with the first connector to connect the twin beam lifting attachment to the pile head;

a rectangular pile configured to be driven between the partial-cylindrical segments of the pile head, wherein a gap is defined between the pile and the partial-cylindrical segments for receiving a poured cement;

a pile head plate fixedly connecting the pair of partial-cylindrical segments, the pile head plate having a pair of curved edges corresponding to the partial-cylindrical segments and a pair of straight edges corresponding to a rectangular pile to frame the gap between the straight edges of the pile and curved edges of the pile head; and a pile driver for driving a rectangular pile into the pile head and toward a surface below the slab for reinforcement;

wherein lifting of the twin beam lifting attachment causes the tubular pile head to lift and raise the slab to a raised position and cement inserted into the gap secures the slab in the raised position.

2. The circular pile head assembly of claim 1, wherein each of the partial-cylindrical segments of the pile head consists of two arcs no more than 120 degrees cut out from a circular pipe to form body sections of the circular pile head.

3. The circular pile head assembly of claim 2, wherein each partial-cylindrical segment of the pile head can be snugly inserted, unobstructed, through the pre-bored hole in the slab.

4. The circular pile head assembly of claim 3, wherein the bearing plates have two edges trimmed off so that it can be inserted unobstructed into the pre-bored through hole in the slab.

5. The circular pile head assembly of claim 4, wherein the trimmed off edges may be of any angle to maximize the bearing area contact with the pre-bored through hole in the slab.

6. The circular pile head assembly of claim 4, wherein each of the bearing plates is strengthened by a plurality of wedges attached to a lower outer body section of the corresponding segment to bear against a soffit in the slab.

7. The circular pile head assembly of claim 1, wherein the shape of each beam can be C-channel, I-Beam or any tabular structure strong enough to withstand the flexure.

8. The circular pile head assembly of claim 1, wherein each beam includes an upper hook and a lower through hole, the circular pile head assembly further comprising a first lock pin inserted through the upper hooks, and a second lock pin inserted through the lower through holes.

9. The circular pile head assembly of claim 1, wherein the pile head plate is welded to the partial-cylindrical segments of the pile head and further strengthened by a plurality of wedges.

10. The circular pile head assembly of claim 4, wherein each of the trimmed edges is aligned with an edge of the underpinning pile.

11. The circular pile head assembly of claim 9, wherein the gaps are filled with cement grout to further strengthen the underpinning pile to the slab.

* * * * *